US012169119B2

(12) United States Patent
Casutt et al.

(10) Patent No.: US 12,169,119 B2
(45) Date of Patent: Dec. 17, 2024

(54) BALLISTIC FIBER COMPOSITIONS, BALLISTIC PROTECTIVE ARTICLES, AND RELATED METHODS

(71) Applicant: Armitek LLC, Orem, UT (US)

(72) Inventors: Dean Casutt, Provo, UT (US); Aaron Gilbert, Provo, UT (US); Bryant Casutt, Provo, UT (US)

(73) Assignee: Armitek LLC, Orem, UT (US)

( * ) Notice: Subject to any disclaimer, the term of this patent is extended or adjusted under 35 U.S.C. 154(b) by 531 days.

(21) Appl. No.: 17/093,233

(22) Filed: Nov. 9, 2020

(65) Prior Publication Data

US 2022/0146233 A1 May 12, 2022

(51) Int. Cl.
*F41H 5/04* (2006.01)

(52) U.S. Cl.
CPC ..... *F41H 5/0428* (2013.01); *F41H 5/0457* (2013.01); *D06N 2201/0272* (2013.01); *D06N 2203/02* (2013.01); *D06N 2205/10* (2013.01); *D06N 2205/14* (2013.01); *D06N 2211/10* (2013.01); *D06N 2211/24* (2013.01); *D10B 2331/021* (2013.01); *D10B 2501/04* (2013.01)

(58) Field of Classification Search
CPC ..... D10B 2331/021; D10B 2501/04; F41H 5/0428; F41H 5/0457; F41H 5/0471; D06N 2201/0272; D06N 2203/02; D06N 2205/10; D06N 2205/14; D06N 2211/10; D06N 2211/24
See application file for complete search history.

(56) References Cited

U.S. PATENT DOCUMENTS

| | | | | |
|---|---|---|---|---|
| 6,200,915 | B1 * | 3/2001 | Adams | D06N 3/128 428/36.1 |
| 9,068,802 | B2 | 6/2015 | Citterio et al. | |
| 10,327,429 | B2 | 6/2019 | Miller et al. | |
| 2011/0008592 | A1 | 1/2011 | Citterio et al. | |
| 2012/0052222 | A1 * | 3/2012 | Gagne | B29C 70/58 264/293 |

(Continued)

FOREIGN PATENT DOCUMENTS

| | | | |
|---|---|---|---|
| WO | 2016/018549 A3 | 2/2016 | |
| WO | WO-2020002511 A1 * | 1/2020 | C08G 64/0241 |

OTHER PUBLICATIONS https://patents.google.com/patent/WO2020002511A1/en?oq=WO2020002511 (Year: 2019).*

*Primary Examiner* — Arti Singh-Pandey
(74) *Attorney, Agent, or Firm* — TraskBritt

(57) ABSTRACT

A ballistic fiber composition may include a fabric that may be comprised of polyamide fibers, an adhesive polymer coating the fabric, and a carbonaceous material and a ceramic filler embedded in the adhesive polymer coating. A method of producing a ballistic protective article may include mixing a carbonaceous material and a ceramic filler into an adhesive to create a mixture, and then coating a polyamide fabric with the mixture. A ballistic protective article may include an aromatic polyamide fabric that is coated with an elastomeric adhesive polymer coating, with calcium carbonate and a carbonaceous material embedded in the elastomeric adhesive polymer coating. The carbonaceous material may include at least one material selected from graphene, carbon nanofiber, and carbon nanotubes.

16 Claims, 5 Drawing Sheets

(56) References Cited

U.S. PATENT DOCUMENTS

| | | | | |
|---|---|---|---|---|
| 2012/0174277 | A1* | 7/2012 | Arvidson | B32B 5/26 2/2.5 |
| 2015/0237929 | A1 | 8/2015 | Greenhill et al. | |
| 2017/0314894 | A1 | 11/2017 | Kremer et al. | |
| 2017/0349749 | A1* | 12/2017 | Dederichs | C08L 9/00 |
| 2017/0368784 | A1 | 12/2017 | Konyu et al. | |

* cited by examiner

BALLISTIC FIBER COMPOSITIONS, BALLISTIC PROTECTIVE ARTICLES, AND RELATED METHODS

TECHNICAL FIELD

Embodiments of the present disclosure relate generally to chemical compositions that may be used for protection against ballistic projectiles. More particularly, this disclosure relates to a fiber composition for use in ballistic protective articles and methods of manufacturing such compositions.

BACKGROUND

Body armor and other forms of ballistic protection are used throughout many industries. Ballistic protection often takes the form of protective clothing that is designed to absorb or deflect physical attacks such as gunfire, while simultaneously protecting the wearer from serious injury. Soldiers, police officers, and security guards often use this type of body armor to perform their jobs effectively and safely.

Two primary types of ballistic protection include non-plated body armor and hard-plate reinforced body armor. These forms of ballistic protection incorporate materials that are bullet-resistant and capable of being woven into wearable articles. With respect to hard-plate reinforced body armor, metal or ceramic plates are incorporated into bullet-resistant vests and provide protection against pistol and rifle bullets. With respect to non-plated body armor, materials made from strong fibers such as woven aramid fiber fabric (e.g., KEVLAR® and TWARON®) are woven into wearable articles that provide ballistic protection against small-caliber firearms.

Using these layers of strong fibers and reinforcing plates, ballistic protective articles catch and deform a bullet, spreading its force over a larger portion of the article. The article absorbs the energy from the deformed bullet and brings it to a stop before it completely penetrates the article's textile matrix. Some layers of the matrix may be penetrated as the bullet deforms, but as the bullet is deformed, its energy is continually absorbed by a larger area, which obstructs further penetration and protects the wearer from serious injury. The current state-of-the-art ballistic protective materials involve a combination of both hard-plate reinforcing components and strong fiber textiles.

BRIEF SUMMARY

Embodiments of the present disclosure disclosed and taught herein are directed to ballistic fiber compositions, including, but not limited to, compositions that include a polyamide material, an adhesive, a carbonaceous material, and a ceramic filler, and that are lightweight, strong, and resistant to ballistic impacts and environmental degradation.

In some embodiments, the present disclosure includes a ballistic fiber composition that includes a fabric, an adhesive polymer coating the fabric, and a carbonaceous material and ceramic filler that are embedded in the adhesive polymer coating.

Another embodiment of the present disclosure includes a method for producing a ballistic protective article (e.g., body armor). The method includes mixing a carbonaceous material and a ceramic filler into an adhesive to create a mixture, and then coating a fabric with the mixture.

Additional embodiments of the present disclosure include a ballistic protective article, which includes a fabric that may be made from aromatic polyamide fibers, an elastomeric adhesive polymer coating the fibers of the fabric, and calcium carbonate and a carbonaceous material that are embedded in the elastomeric adhesive polymer coating. The carbonaceous material may include at least one material selected from among graphene, carbon nanofiber, and carbon nanotubes.

BRIEF DESCRIPTION OF THE DRAWINGS

While the specification concludes with claims particularly pointing out and distinctly claiming what are regarded as embodiments of the present disclosure, various features and advantages of this disclosure may be more readily ascertained from the following description of example embodiments provided with reference to the accompanying drawings, in which:

DETAILED DESCRIPTION

Figure 1:
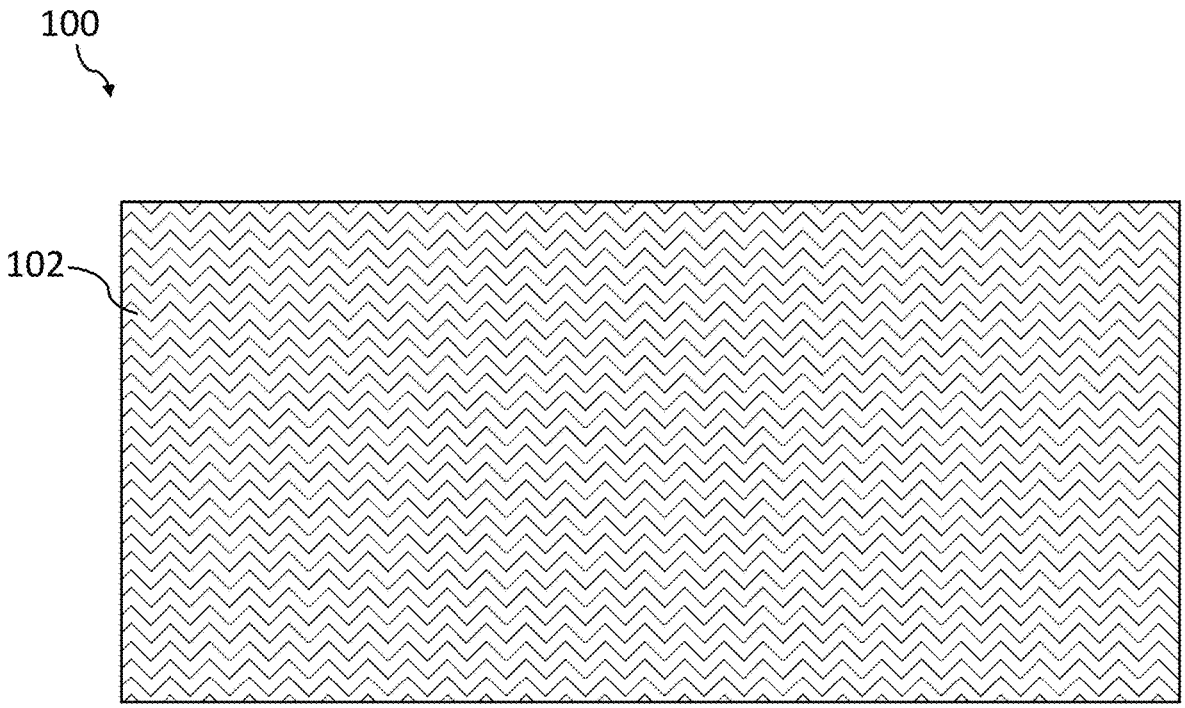
FIG. 1 illustrates a schematic view of a ballistic fiber composition in accordance with an embodiment of the present disclosure.

Embodiments of the present disclosure disclosed and taught herein are directed to chemical compositions and related methods of manufacturing them, including, but not limited to, ballistic fiber compositions that may be used in ballistic protective articles and include a polyamide material, an adhesive, a carbonaceous material, and a ceramic filler.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the singular forms following "a," "an," and "the" are intended to include the plural forms as well, unless the context clearly indicates otherwise.

As used herein, the term "about" in reference to a numerical value for a particular parameter is inclusive of the numerical value and a degree of variance from the numerical value that one of ordinary skill in the art would understand is within acceptable tolerances for the particular parameter. For example, "about" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the terms "ballistic fiber" and "ballistic protective article" and their equivalents refer to any chemical composition or to any structure that shields against ballistic impacts, or that absorbs or deflects physical attacks such as gunfire, while simultaneously protecting the wearer from serious injury.

The illustrations presented herein are not actual views of any particular material, article, or method, but are merely idealized representations that are employed to describe embodiments of the present disclosure. The figures are not necessarily drawn to scale. Additionally, elements common between figures may retain the same numerical designation.

State-of-the-art ballistic protective materials involve a combination of both hard-plate reinforcing components and strong fiber textiles. However, these materials suffer from a limited lifespan, environmental degradation, and failure after multiple impacts. Woven aramid fiber body armor such as Kevlar®, for example, has a five-year lifespan, and once the armor is pierced, its structural integrity is compromised and additional shots are more likely to penetrate the armor. Additionally, any moisture in the atmosphere (such as that from humidity, sweat, or rain) often nullifies the ballistic protective properties of many conventional materials and decreases the useful life of the armor. Hard-plate components that may be used in the armor also add a significant amount of weight to body armor, which is disadvantageous for wearers that need to move quickly or that are stationed in hot climates. Hard-plate components also locally shatter in the area that the projectile strikes, which means that the plates become progressively less capable of stopping additional projectiles, and may be rendered unusable after a certain number of hits have been absorbed. Embodiments of the present disclosure attend to these disadvantages and are directed to ballistic fiber compositions that may be used in fabricating lightweight, strong, and bullet-resistant ballistic protective articles (e.g., body armor) that have an increased lifespan and are resistant to environmental degradation.

Figure 2:
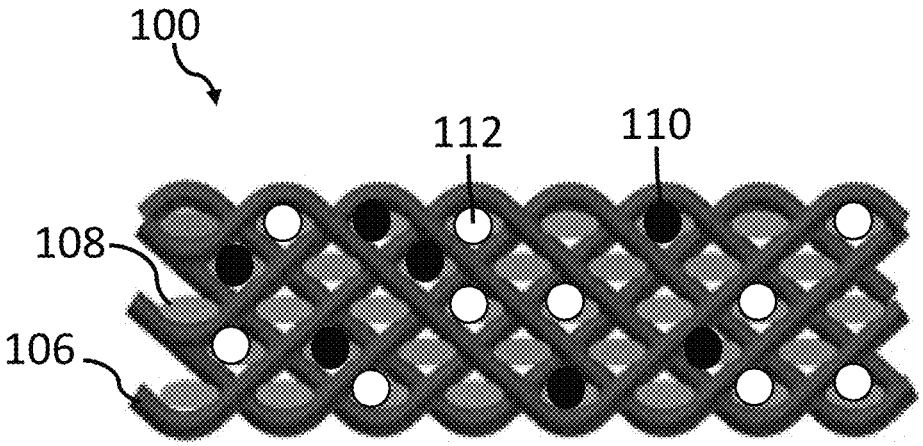
FIG. 2 illustrates a cross-sectional schematic view of a ballistic fiber composition in accordance with an embodiment of the present disclosure.

FIG. 1 schematically illustrates a ballistic fiber composition 100 including a fabric 102 in accordance with an embodiment of the present disclosure, and FIG. 2 schematically illustrates a cross-sectional view of the ballistic fiber composition 100 in accordance with an embodiment of the present disclosure. For example, as is described in greater detail below, the ballistic fiber composition 100 may protect against ballistic impacts such as gunfire. For instance, when a bullet strikes the ballistic fiber composition, it is caught by the fibers within the fabric. The fibers then absorb and disperse the impact energy of the bullet until it has been stopped.

In some embodiments, the ballistic fiber composition 100 may include polyamide fibers 106, an adhesive polymer 108, a carbonaceous material 110, and a ceramic filler 112. Referring to FIGS. 1 and 2 together, the ballistic fiber composition 100 may include a fabric 102, which may be comprised of the polyamide fibers 106. More particularly, the polyamide fibers 106 may include an aromatic polyamide.

The ballistic fiber composition 100 may further include an adhesive polymer 108 coating the polyamide fibers of the fabric 102. The adhesive polymer 108 may be made from any thermosetting polymer, such as an elastomer, which may be rubber. More particularly, the rubber may include neoprene, for example.

A carbonaceous material 110 may be embedded in the adhesive polymer 108 coating the fabric 102. As a non-limiting example, the carbonaceous material 110 may include graphene, carbon nanofiber, carbon nanofibers, and similar materials.

In some embodiments, the carbonaceous material 110 may be combined with or, alternatively, replaced with a metallic material. The metallic material may include, for example, brass powder, tungsten powder, titanium powder, bronze powder, copper powder, bronze pellets, copper pellets, titanium strands, bronze strands, copper strands, or a combination of two or more of these materials.

A ceramic filler 112 may also be embedded in the adhesive polymer 108 coating the fabric 102. This ceramic filler 112 may comprise ceramic and glass-ceramic materials. As a non-limiting example, the ceramic filler 112 may comprise calcium carbonate, silica, tungsten carbide, silicon carbide, titanium carbide, or a combination of two or more of these materials.

The adhesive polymer 108 coating the fabric 102 may optionally comprise a colorant, such as carbon black.

The fabric 102 may optionally comprise a coating that may include, for example, talcum powder, a hydrophobic material such as an oil, a fluorinated silane, a fluoropolymer, a zinc oxide polystyrene composite, silica, calcium carbonate, carbon nanotubes, or a combination thereof. This coating may improve the stab resistant properties of the fabric.

In accordance with an embodiment of the present disclosure, a mixture comprised of the adhesive polymer 108, the carbonaceous material 110, the ceramic filler 112, and a colorant may be applied to the fibers of the fabric 102 to form the ballistic fiber composition 100. The adhesive polymer may comprise from about 10% to about 90%, and more particularly from about 65% to about 95% (e.g., about 80%) of the mixture. The carbonaceous material 110 may comprise from about 0.05% to about 5%, and more particularly from about 0.1% to about 1.5% (e.g., about 0.5%) of the mixture. The ceramic filler 112 may comprise from about 5% to about 60%, and more particularly from about 10% to about 30% (e.g., about 18%) of the mixture. The colorant may comprise from about 0.1% to about 5%, and more particularly from about 0.15% to about 1.5% (e.g., about 1%) of the mixture. The percentages disclosed are measured in volumetric percent.

Figure 3:
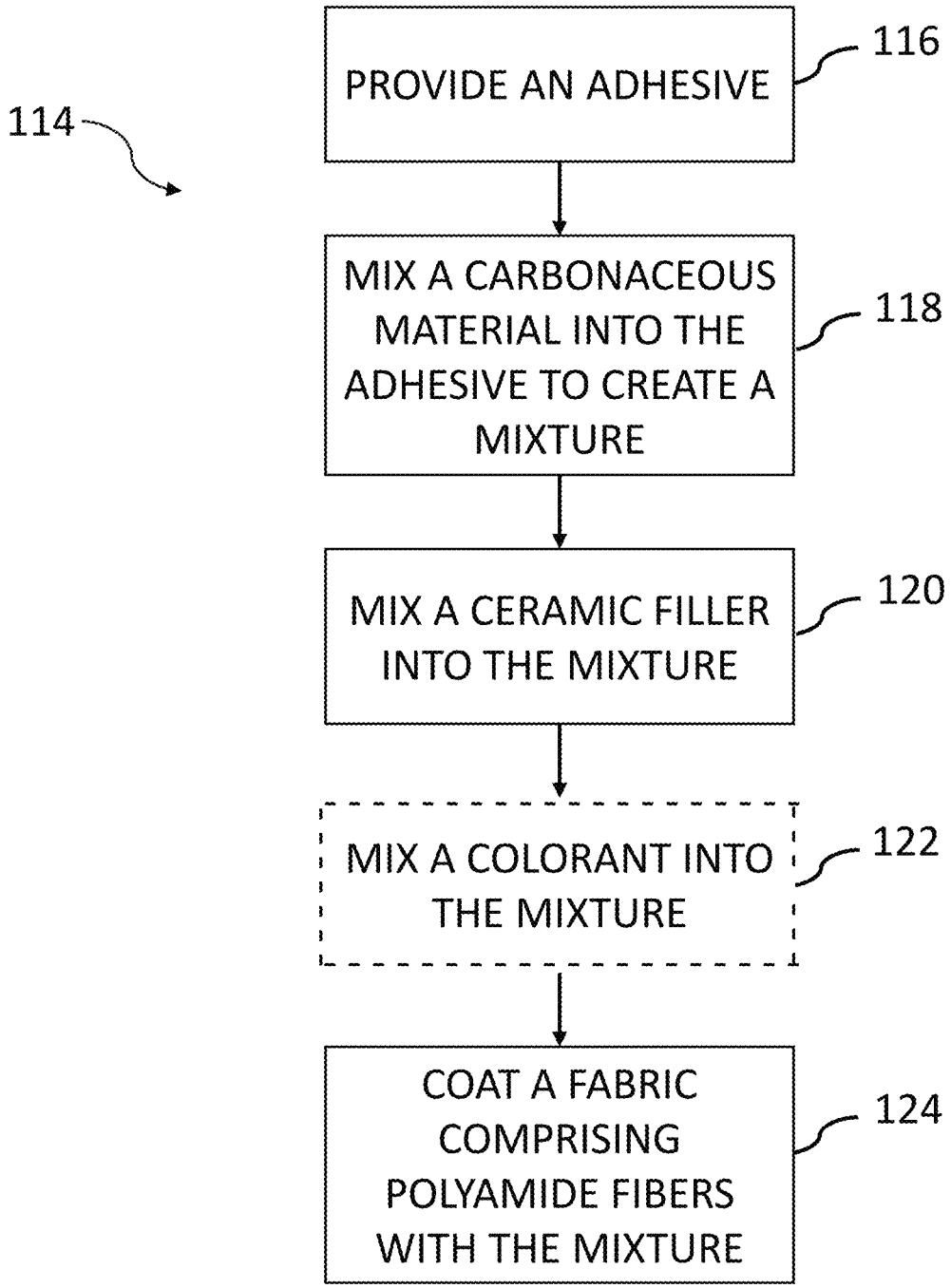
FIG. 3 is a flow chart illustrating a method of forming a ballistic protective article in accordance with an embodiment of the present disclosure.

FIG. 3 includes a flow chart 114 that illustrates a method of forming a ballistic protective article in accordance with an embodiment of the present disclosure. As shown in act 116, an adhesive may be provided. The adhesive may include any thermosetting polymer, such as an elastomer, which may be rubber. More particularly, the rubber may include neoprene, for example.

As shown in act 118, a carbonaceous material may be added into the adhesive to create a mixture. As a non-limiting example, the carbonaceous material may comprise a purity of greater than 80% and may include at least one material selected from graphene, carbon nanofiber, or carbon nanotubes. These materials are advantageous due to their strength, elasticity, light weight, and other properties. The carbonaceous material is mixed into the adhesive until it is fully dispersed throughout the solution.

In some embodiments, the carbonaceous material may be combined with or, alternatively, replaced with a metallic material. The metallic material may include, for example, brass powder, tungsten powder, titanium powder, bronze powder, copper powder, bronze pellets, copper pellets, titanium strands, bronze strands, copper strands, or a combination of two or more of these materials.

As shown in act 120, the ceramic filler may be mixed into the adhesive mixture. The ceramic filler may comprise ceramic and glass-ceramic materials. More particularly, the ceramic filler may comprise, for example, calcium carbonate or silica. The ceramic filler is mixed into the adhesive mixture until it is fully dispersed throughout the solution.

The carbonaceous material and the ceramic filler may be formed into powders, nano-powders, nanotube powders, particles, flakes, pellets, sheets, nanotubes, or other forms prior to being mixed into the adhesive.

As shown in act 122, a colorant may optionally be mixed into the adhesive mixture. The colorant may include carbon black. The carbonaceous material, ceramic filler, and optional colorant may be added separately or mixed together and incorporated slowly into the adhesive for a period of time such as, for example, ten to thirty minutes, to evenly distribute the materials within the adhesive polymer mixture. The materials may be mixed together through any method known in the art, such as through use of a turbulent dual mixer, a shear mixer, etc. The mixture may comprise the weight percentages of its component parts listed herein. The percentages may be adjusted upward or downward depending on the desired characteristics of the finished ballistic protective article.

As shown in act 124, a fabric may be coated with the mixture. The mixture may be applied to the fabric through coating it, setting it, embedding it, rubbing it, soaking it, or otherwise incorporating it into the fabric. The fabric may include polyamide fibers. More particularly, the polyamide fibers may include an aromatic polyamide. The fabric may also be scoured to remove all oils that may be present on it prior to being coated with the mixture. The fabric may further comprise a woven or a non-woven pattern, and may be constructed of materials that may include, for example, graphene powder, brass powder, tungsten powder, tungsten carbide powder, titanium powder, bronze powder, copper powder, bronze pellets, copper pellets, graphene fibers, composite fibers, nanocomposite fibers, polyethylene fibers, nylon fibers, carbon fibers, boron fibers, glass fibers, silicon carbide fibers, ceramic fibers, titanium strands, bronze strands, copper strands, aramid fibers, or a combination of two or more of these materials.

The mixture may be applied to the aramid fiber (e.g., a fabric comprised of aramid fiber) by coating the fibers with the mixture evenly, and rubbing the mixture into the fibers until a uniform coating is achieved. The coating may be allowed to dry for a period of time before subsequent coatings are applied. As a non-limiting example, the coating may be allowed to dry for a minimum of 15 minutes before subsequent coats are applied to the fibers. At least one coating of the mixture may be applied to both sides of the aramid fiber fabric. The coated fabric may be allowed to dry for about 2 hours before the mixture is applied to the opposite side of the fabric. The fabric may be allowed to cure for at least 1 day before a ballistic protective article is formed from it.

The infused fabric may optionally be coated with a material such as, for example, talcum powder, a hydrophobic material such as an oil, a fluorinated silane, a fluoropolymer, a zinc oxide polystyrene composite, silica, calcium carbonate, carbon nanotubes, or a combination thereof. This coating may improve the stab resistant properties of the fabric.

Figure 4:
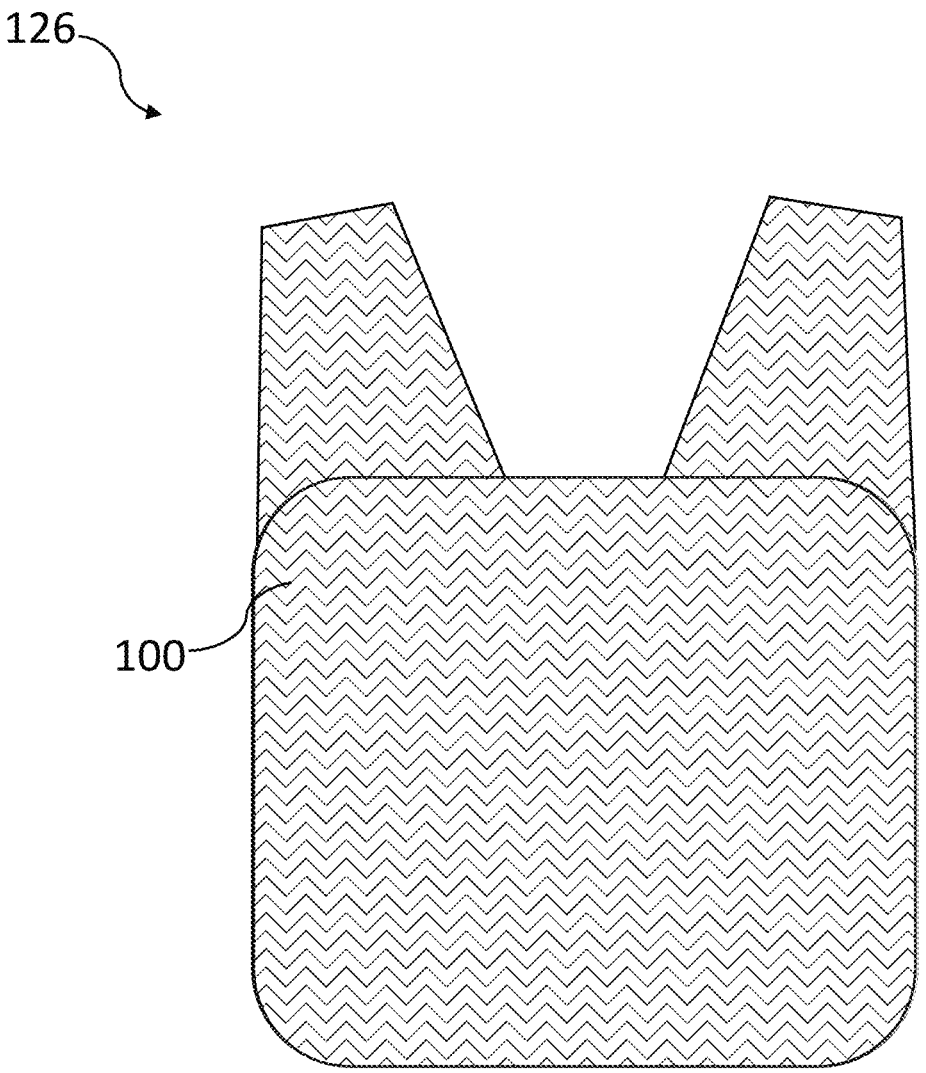
FIG. 4 illustrates a schematic view of a ballistic protective article in accordance with an embodiment of the present disclosure.

FIG. 4 schematically illustrates a ballistic protective article 126 in accordance with an embodiment of the present disclosure. For example, as is described in greater detail below, a ballistic protective article 126 may take the form of a wearable textile such as a vest or a helmet, and may also take the form of a mobile article, such as a shield.

In some embodiments, the ballistic protective article 126 may include a ballistic fiber composition 100, which may include the components previously described herein. The ballistic fiber composition 100 may include fibers that are woven or non-woven, and may optionally include more than one layer. The fibers may be woven in a tabby weave, for example, where the fibers are interlaced in an over-under pattern. The fibers may optionally be weaved into a three-dimensional system, with a three-axis fiber orientation. The ballistic fiber composition 100 may include continuous or discontinuous fibers.

When the fibers of the ballistic protective composition 100 are aligned, the properties of the ballistic protective article 126 are maximized along the direction of alignment and are thus highly anisotropic. However, the properties of the article 126 may be considerably weaker along other directions. If anisotropic properties are desired within the ballistic protective article 126, the ballistic fiber composition 100 may include fibers that are laid parallel or perpendicular to each other.

If a more uniform and isotropic performance of the ballistic protective article 126 is desired, the fiber composition 100 may include randomly oriented fibers. Another method of producing isotropic properties within the ballistic protective article 126 includes using multiple layers of the fabric 102 including ballistic fiber composition 100, where the fibers within each layer are aligned differently. For example, the alignment of the fibers within each layer can vary by 90°, 45°, or 30° angles to improve the isotropic properties of the ballistic protective article 126. The alignment of the fibers may be altered depending on the desired characteristics of the finished ballistic protective article.

Although the ballistic protective article 126 can prevent bullet penetration, the article and the wearer still absorb the impact force of the bullet. The impact force may be great enough to cause serious injury to the wearer's body. The backface deformation is a measure of the degree that the ballistic protective article 126 deforms into the wearer's body when it is impacted by a bullet. To protect the wearer, the ballistic protective article 126 should reduce the backface deformation as much as possible. A large degree of backface deformation may induce necrosis and even fatal injuries to the wearer. More particularly, a large degree of backface deformation does not allow the wearer to promptly react to an attack due to the shock absorbed by the human body. According to the National Institute of Justice, an institution that creates broadly-accepted body armor standards, the backface deformation of ballistic protective articles must be less than or equal to 44 millimeters.

In accordance with some embodiments of the present disclosure, the ballistic protective article 126 has a backface deformation of less than 44 millimeters, and more particularly less than 40 millimeters (e.g., about 38 millimeters) when subjected to testing in accordance with the National Institute of Justice Standard, NIJ Standard-0101.06 (Level IIIA), July 2008 revision, as shown in Table 1 below. The uncoated aramid fiber includes conventional aramid fiber protective articles, whereas the coated aramid fiber includes the ballistic protective article 126 of the disclosure. As shown in Table 1, the ballistic protective article 126 showed less backface deformation when subjected to ballistic rounds, thus showing improved performance when compared with conventional ballistic protective articles.

TABLE 1

Backface Deformation Analysis

| Material | Number of Layers | Pre-Conditioning | Handgun Used | Average Backface Deformation (mm) |
|---|---|---|---|---|
| Uncoated Aramid Fiber | 25 | None | 0.357 in. Magnum | 31.18 |
| Coated Aramid Fiber | 25 | None | 0.357 in. Magnum | 8.34 |
| Uncoated Aramid fiber | 25 | Soaked in water for 20 minutes | 9 mm | Failed |
| Coated Aramid Fiber | 25 | Soaked in water for 20 minutes | 9 mm | 18.5 |

Figure 5:
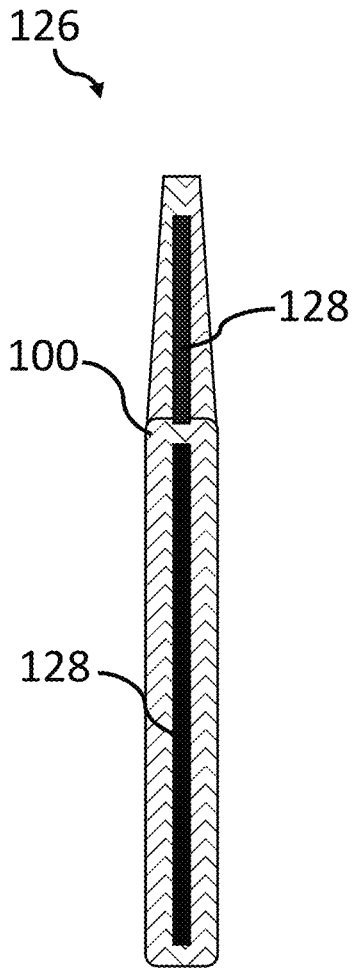
FIG. 5 illustrates a cross-sectional schematic view of a ballistic protective article in accordance with an embodiment of the present disclosure.

FIG. 5 schematically illustrates a cross-sectional view of a ballistic protective article 126 in accordance with an embodiment of the present disclosure. The ballistic protective article 126 may, for example, take the form of a wearable textile such as a vest, or a mobile article such as a shield.

In some embodiments, a ballistic protective article 126 may include a ballistic fiber composition 100 as disclosed herein and may optionally include hard-plate inserts 128. The inserts 128 may be used with a wearable textile or a mobile article and provide additional protection against higher-caliber bullets. The inserts 128 may be made of metallic materials such as steel or titanium, ceramic materials such as silicon carbide, polymeric materials such as polyethylene, or a combination of those materials. The inserts 128 may be encapsulated by the ballistic fiber composition 100; more particularly, the inserts 128 may be sewn into or hermetically sealed into the fabric 102 comprised of the ballistic fiber composition 100 to form the ballistic protective article 126.

The ballistic protective article 126 may further incorporate coated and laminated para-aramid textiles or metallic components as part of the ballistic fiber composition 100, as part of the inserts 128, or as part of both.

In addition to body armor, the ballistic protective article 126 disclosed herein may be employed in various other protective applications, such as, for example, protection in a vehicle, a vessel, an aircraft, or in structural applications.

The following examples serve to further illustrate embodiments of the present disclosure in more detail. These examples are not to be construed as being exhaustive or exclusive as to the scope of this disclosure.

EXAMPLES

For exemplary purposes, methods of producing a ballistic protective article in accordance with embodiments of the present disclosure are described. In one method, the adhesive polymer was a neoprene-based adhesive (commercially available from DAP Products, Inc. (Baltimore, MD) under the Weldwood® Nonflammable Contact Cement tradename). Carbon fibers were used as the carbonaceous material (commercially available from Solid Carbon Products (Provo, Utah)). Calcium carbonate was used as the ceramic filler (commercially available from BulkSupplements.com (Henderson, Nevada)). A water-based black coloring was used as the colorant (commercially available from Chromaflo Technologies (Ashtabula, Ohio) under the Cal-Tint® II tradename). Aramid fiber was used as the fabric (commercially available from Barrday, Inc. (Cambridge, Ontario, Canada) or Lincoln Fabrics (Grimsby, Ontario, Canada)).

Four gallons of the adhesive polymer were poured into a five-gallon bucket. A half of a cup of the carbon fibers were added to the adhesive polymer through a sifter, and the mixture was simultaneously stirred to disperse the carbon fibers throughout the adhesive polymer. Eighteen cups of the ceramic filler were added to the mixture through a sifter, and the mixture was simultaneously stirred to disperse the ceramic filler throughout. Two and one third cups of the colorant were poured into the mixture, and the mixture was simultaneously stirred to disperse the colorant throughout the mixture. After each of the components were added into the adhesive polymer, the mixture was further stirred to ensure that each component was evenly dispersed throughout the adhesive polymer mixture. In total, the mixture may be stirred for up to an hour, and more particularly, from ten to thirty minutes (e.g., about fifteen minutes).

The mixture was then applied to about fifty-four linear yards of the aramid fiber (e.g., a fabric comprised of aramid fibers). The fabric was evenly coated with the mixture, and the mixture was rubbed into the fabric until a uniform coating was achieved. The coating was allowed to dry for about 15 minutes before a second coating was applied. The coated fabric was allowed to dry for about 2 hours before the mixture was applied to the opposite side of the fabric. The first coating on the opposite side of the fabric was applied in the same manner described above and was allowed to dry for at least 15 minutes before a second coating was applied. The fabric was allowed to cure for about 2 days before a ballistic protective article was formed from it.

Another method of producing a ballistic protective article includes using many of the same components described above, but in different quantities. One gallon of the adhesive polymer was poured into a five-gallon bucket. A tablespoon and a half of a carbon fiber/graphene mixture (commercially available from Solid Carbon Products (Provo, UT)) was added to the adhesive polymer through a sifter, and the mixture was simultaneously stirred to disperse the carbon fibers throughout the adhesive polymer. Three and a half cups of the ceramic filler were added to the mixture through a sifter, and the mixture was simultaneously stirred to disperse the ceramic filler throughout. Seventy grams of the colorant were poured into the mixture, and the mixture was simultaneously stirred to disperse the colorant throughout the mixture. After each of the components were added into the adhesive polymer, the mixture was further stirred to ensure that each component was evenly dispersed throughout the adhesive polymer mixture. The mixture was then applied to about fifty-four linear yards of the aramid fiber (e.g., a fabric comprised of aramid fibers) in the same manner described above with regard to the first method, and a ballistic protective article was formed from it.

Although the foregoing descriptions contain many specifics, these are not to be construed as limiting the scope of the present disclosure, but merely as providing certain exemplary embodiments. Similarly, other embodiments of the disclosure may be devised that do not depart from the scope of the present disclosure. For example, features described herein with reference to one embodiment may also be provided in others of the embodiments described herein. The scope of the embodiments of the invention is, therefore, indicated and limited only by the appended claims and their legal equivalents, rather than by the foregoing description. All additions, deletions, and modifications to the disclosure, as disclosed herein, which fall within the meaning and scope of the claims, are encompassed by the present disclosure.

What is claimed is:

1. A ballistic fiber composition, comprising:

a fabric comprising polyamide fibers;

an adhesive polymer coating the polyamide fibers of the fabric;

a carbonaceous material embedded in the adhesive polymer coating, wherein the carbonaceous material comprises at least one material selected from among graphene, carbon nanofiber, and carbon nanotubes;

a ceramic filler embedded in the adhesive polymer coating; and a hard-plate insert encapsulated by the fabric.

2. The composition of claim 1, further comprising a metallic material embedded into the adhesive polymer coating.

3. The composition of claim 2, wherein the metallic material comprises at least one material selected from among brass, bronze, copper, titanium, and tungsten.

4. The composition of claim 1, wherein the polyamide fibers comprise an aromatic polyamide.

5. The composition of claim 1, wherein the adhesive polymer comprises an elastomer.

6. The composition of claim 5, wherein the elastomer comprises rubber.

7. The composition of claim 1, wherein the ceramic filler comprises calcium carbonate.

8. A ballistic protective article, comprising:

a fabric comprising aromatic polyamide fibers;

an elastomeric adhesive polymer coating the fibers of the fabric;

a carbonaceous material embedded in the elastomeric adhesive polymer coating, the carbonaceous material comprising at least one material selected from among graphene, carbon nanofiber, and carbon nanotubes;

calcium carbonate embedded into the elastomeric adhesive polymer coating; and a hard-plate insert encapsulated by the fabric.

9. The article of claim 8, wherein the ballistic protective article has a backface deformation of less than 40 millimeters when subjected to testing in accordance with the National Institute of Justice Standard, NIJ Standard-0101.06 (July 2008 revision).

10. A method for producing a ballistic protective article, comprising:

providing an adhesive polymer;

mixing a ceramic filler and a carbonaceous material comprising at least one material selected from among graphene, carbon nanofiber, and carbon nanotubes into the adhesive polymer to create a mixture;

coating a fabric comprising polyamide fibers with the mixture; and encapsulating a hard-plate insert with the fabric.

11. The method of claim 10, further comprising mixing a metallic material into the mixture.

12. The method of claim 11, wherein the metallic material comprises at least one material selected from among brass, bronze, copper, titanium, and tungsten.

13. The method of claim 10, wherein the polyamide fibers comprise an aromatic polyamide.

14. The method of claim 10, wherein the adhesive polymer comprises an elastomer.

15. The method of claim 14, wherein the elastomer comprises rubber.

16. The method of claim 10, wherein the ceramic filler comprises calcium carbonate.

* * * * *